United States Patent [19]

Lee

[11] 4,292,505

[45] Sep. 29, 1981

[54] FURNACE FOR GENERATING HEAT BY ELECTRICAL RESISTANCE

[76] Inventor: Jeoung K. Lee, 6231 Fuji Tou, Fuji Tsawa-City, Kanakawa-Ken, Japan

[21] Appl. No.: 76,849

[22] Filed: Sep. 19, 1979

[30] Foreign Application Priority Data

May 9, 1979 [PH] Philippines ..... 22468

[51] Int. Cl.[3] ..... H05B 3/10

[52] U.S. Cl. ..... 219/553; 219/541; 219/546; 252/506; 338/225; 338/226; 338/325; 13/25

[58] Field of Search ..... 219/528, 541, 534, 546, 219/548, 549, 552, 553; 252/502, 503, 506, 510, 511; 13/25; 338/22 R, 225 D, 212, 214, 314, 334, 238, 240, 223, 224, 225, 226, 325

[56] References Cited

U.S. PATENT DOCUMENTS

| | | | |
|---|---|---|---|
| 2,991,257 | 7/1961 | Smith-Johannsen | 252/506 |
| 3,277,419 | 10/1966 | Butz | 338/314 |
| 3,287,684 | 11/1966 | Armbruster, Jr. | 219/549 X |
| 3,400,254 | 9/1968 | Takemori | 219/549 |
| 3,419,840 | 12/1968 | Wright | 252/506 X |
| 3,439,306 | 4/1969 | Schimmel | 332/212 |
| 3,498,929 | 3/1970 | Accountius | 252/503 |
| 3,923,697 | 12/1975 | Ellis | 252/506 |

*Primary Examiner*—Volodymyr Y. Mayewsky
*Attorney, Agent, or Firm*—Fulwider, Patton, Rieber, Lee & Utecht

[57] ABSTRACT

A furnace having a body in which electrically resistive material is positioned between two electrodes so that heat can be generated by passing a current through the material. The resistive material is a mixture of carbonized plant material and a non-organic material that acts as a insulator at low temperatures and acts as a conductor or semi-conductor at high temperatures.

1 Claim, 2 Drawing Figures

FURNACE FOR GENERATING HEAT BY ELECTRICAL RESISTANCE

FIELD OF THE INVENTION

The present invention relates to electrically resistant heat generating furnaces which employ carbon particles as contact resistance heat generating elements.

BACKGROUND OF THE INVENTION

Conventionally, heat generating furnaces of the present type are constructed by filling a space between two electrodes with carbon particles and applying an electrical potential to the electrodes. Since the resistance value of carbon particles reduces suddenly in a high temperature region, control of the voltage and current is difficult.

An objective of the present invention is to provide a heat generating furnace capable of eliminating such problems.

SUMMARY OF THE INVENTION

The present invention resides in a furnace in which the material between the electrodes is a mixture of carbonized plant material and a non-organic material that acts as an insulator below a predetermined temperature and acts as a conductor or semi-conductor above that predetermined temperature. A carbonized binder can be used to join the above materials.

Preferably, the material is formed as lumps sintered and then pulverized.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 1:
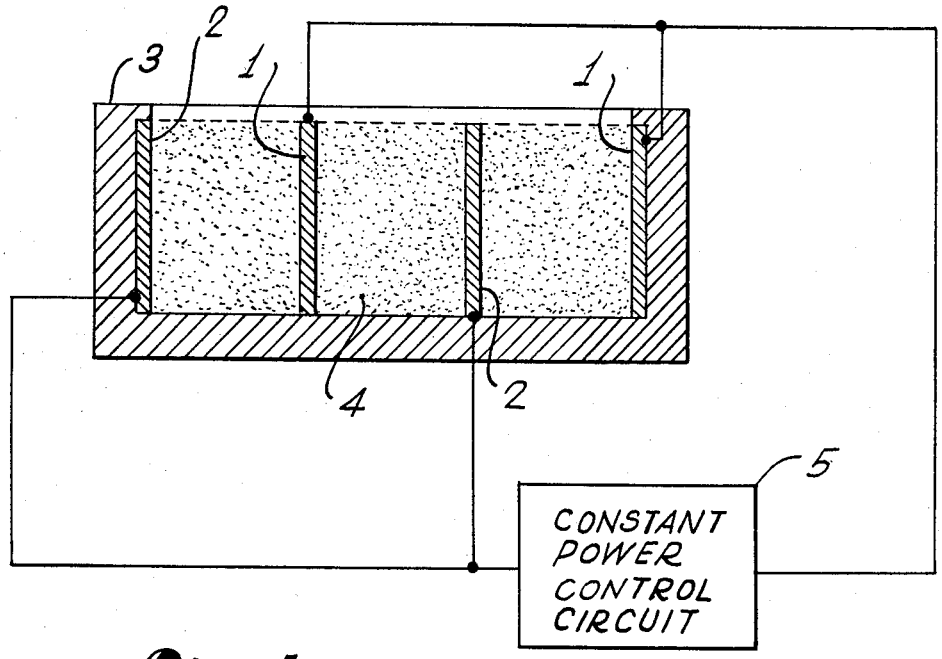
FIG. 1 is a schematic cross-sectional illustration of a furnace constructed in accordance with the present invention.

A furnace constructed in accordance with the present invention and shown in FIG. 1 of the accompanying drawings includes heat generating elements 4 filled between two electrodes 1 and 2, all of which are within the furnace body 3. The electrodes 1 and 2 are connected to a constant power circuit 5.

Figure 2:
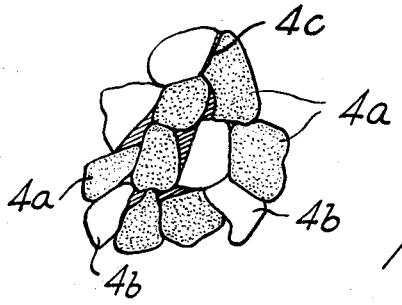
FIG. 2 is an enlarged pictorial illustration of a heat generating element used in the furnace of FIG. 1.

The heat generating elements 4 (FIG. 2) comprise carbon particles 4*a* obtained by pulverizing a carbonized plant material and non-organic particles 4*b* of a metallic compound which is electrically insulating below a predetermined temperature and serves as a semi-conductor or a conductor above the predetermined temperature. A carbonized binder 4*c* joins these particles 4*a* and 4*b*. A binding agent such as polyvinyl alcohol, which is carbonized in a sintering process, can be used as the binder 4*c*.

The ratio of the carbon particles 4*a* of the heat generating element 4 to the non-organic particles 4*b* is such that the percentage of carbon particles is far larger than that of the non-organic particles; for example, the ratio may be 4:1 or 5:1.

The following is an example of a method for manufacturing the heat elements 4.

EXAMPLE

| | |
|---|---|
| Carbon particles of 500 mesh grain size | 5 parts |
| Silica of 500 mesh grain size | 1 part |
| Polyvinyl alcohol | 0.5 parts |
| Water | 1 part |

Lumps are made by kneading the above-mentioned materials, heated at 1,500° C. for an hour in the electric furnace and pulverized after cooling to obtain heat generating elements 4 to 0.1 to 1 mm in size.

When these heat generating elements 4 were used, the results shown in Table 1 were obtained. It was ascertained that the voltage decrease characteristic and the current increase characteristic over a period of time are moderate.

TABLE 1

| | Initial Stage | 3 min. later | 10 min. later |
|---|---|---|---|
| Voltage (V) | 100 | 53 | 28 |
| Current (A) | 1 | 3.7 | 15 |
| Furnace Temp. (°C.) | | | 1,860 |

In the heat generating furnace of the present invention, constructed as described above, the resistance heat is generated from the contact surface of the heat generating elements 4, when an electric current is supplied across the electrodes 1 and 2. The furnace temperature rises while said resistance heat is retained by the heat generating elements 4. The resistance variation of the heat generating element 4 due to the temperature increase appears as a variation of the magnitude of electric current and, therefore, the voltage and current are controlled by the constant power control circuit 5.

The furnace is highly advantageous in that an increase in the furnace temperature can be caused by increasing the heat retaining performance since the heat generating elements 4 contain non-organic particles 4*b*, and the resistance variation characteristic of the composite heat generating elements 4 can be moderate. Accordingly the voltage and current can be controlled easily since the non-organic particles 4*b* serve as a fixed resistor when the furnace temperature exceeds the predetermined value.

While a particular form of the invention has been illustrated and described, it will also be apparent that various modifications can be made without departing from the spirit and scope of the invention.

I claim:

1. A controlled electrically resistant heat generating furnace comprising:

a furnace body;

a plurality of electrodes secured in and to oppose each other within said furnace body;

a plurality of heat generating elements disposed between said electrodes; and constant power control circuit means for supplying an electric current across said electrodes;

said heat generating elements comprising a substantially homogencous mixture of carbonized plant particles, non-organic particles and a carbonized binder, the amount by weight of said carbonized plant particles in said mixture being greater than the amount by weight of said non-organic particles, and said non-organic particles being electrical insulators below a predetermined temperature and being conductors or semiconductors above said predetermined temperature.

* * * * *